US007231850B2

(12) United States Patent
Wang

(10) Patent No.: US 7,231,850 B2
(45) Date of Patent: Jun. 19, 2007

(54) MANUAL WINE BOTTLE OPENER

(76) Inventor: Ching-Chen Wang, P.O. Box 90, Tainan City 70499 (TW)

( * ) Notice: Subject to any disclaimer, the term of this patent is extended or adjusted under 35 U.S.C. 154(b) by 0 days.

(21) Appl. No.: 11/268,540

(22) Filed: Nov. 8, 2005

(65) Prior Publication Data

US 2007/0101829 A1 May 10, 2007

(51) Int. Cl.
*B67B 7/00* (2006.01)
*B67B 7/08* (2006.01)

(52) U.S. Cl. ..... 81/3.2; 81/3.29; 81/3.48

(58) Field of Classification Search ..... 81/3.2, 81/3.29, 3.48, 3.37; D8/42
See application file for complete search history.

(56) References Cited

U.S. PATENT DOCUMENTS 1,140,082 A * 5/1915 Stapley ..... 81/3.2
1,275,228 A * 8/1918 Crowe et al. ..... 81/3.2
1,921,811 A * 8/1933 Eger ..... 81/3.2
5,012,703 A * 5/1991 Reinbacher ..... 81/3.29
6,622,595 B1 * 9/2003 Federighi ..... 81/3.48
6,941,839 B1 * 9/2005 Syu ..... 81/3.2
D511,664 S * 11/2005 Lee ..... D8/42

* cited by examiner

*Primary Examiner*—Hadi Shakeri

(57) ABSTRACT

A manual wine bottle opener includes a main body, a fixing base, a piston rod, a press lever, a valve base, a thimble, a sleeve and a slide member combined together. The press lever has one end pivotally combined with a connecting member, and the piston rod has its lower end fitted with a piston. The valve base has its interior provided with a non-return valve and its lower side fixed with an insert needle. By reciprocally pulling and pressing the press lever for moving the piston up and down repeatedly, air can be pumped into the wine bottle through the insert needle for removing the cork of the wine bottle from the bottle mouth, able to uncork the wine bottle conveniently and quickly. Then the sleeve is turned around to actuate the slide member to whirl and move downward to push and disengage the cork from the insert needle.

1 Claim, 7 Drawing Sheets

MANUAL WINE BOTTLE OPENER

BACKGROUND OF THE INVENTION

1. Field of the Invention

This invention relates to a manual wine bottle opener, particularly to one able to remove the cork of a wine bottle from the bottle mouth conveniently and quickly by reciprocally pulling and pressing a press lever to move a piston up and down repeatedly and pump air into the interior of the wine bottle through an insert needle. In addition, the cork can be pushed to separate from the insert needle by turning around a sleeve to actuate a slide member to whirl and move downward. So the manual wine bottle opener is convenient in use.

2. Description of the Prior Art

Generally, a wind or champagne bottle has its bottle mouth stuffed with a cork. To drink wind or champagne in a bottle, a pointed-needle shaped bottle opener is inserted in the cork for uncorking the wine bottle. A conventional bottle opener 1 for uncorking a wine bottle, as shown in FIG. 1, has its upper side provided with a handle 10 and its lower side fixed with a helical awl 11 extending downward from the handle 10. In use, the helical awl 11 is inserted in the cork 19 stuffed in the bottle mouth 18 of a wine bottle and then the handle 10 is turned around to actuate the helical awl 11 to be helically drilled downward. When drilled into the cork 19 to a substantial depth, the helical awl 11 is pulled outward to remove the cork 19 from the bottle mouth 18. Since the cork 19 is forcedly pushed tight in the bottle mouth 18 in a way of tight fit in order to prevent the flavor of wine in the bottle from running out and lost or deteriorated; therefore, it must take a lot of exertion to pull the cork 19 out of the bottle mouth 18. In addition, in case the helical awl 11 is drilled into the cork 19 not deep enough, the cork 19 may be impossible to be pulled out and likely to be broken. On the contrary, if the helical awl 11 is drilled excessively deep, chips of the cork 19 may drop to the wine in the wine bottle 17, thus influencing the quality of the contents.

SUMMARY OF THE INVENTION

The objective of the invention is to offer a manual wine bottle opener able to remove the cork of a wine bottle form the bottle mouth conveniently and quickly.

The manual wine bottle opener in the present invention includes a main body having its interior formed with an accommodating chamber. A fixing base is fixedly assembled on the main body and bored with an insert hole in the center, and a piston rod with a piston fitted at the underside is inserted through the insert hole of the fixing base and positioned in the accommodating chamber of the main body. A press lever is pivotally assembled on the topside of the piston rod, and a valve base provided with an air intake and a non-return valve is firmly received in the accommodating chamber of the main body. An insert needle having an air intake and an air-exhausting hole is combined at the underside of the valve base, and a thimble is firmly combined with the lower side of the main body.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
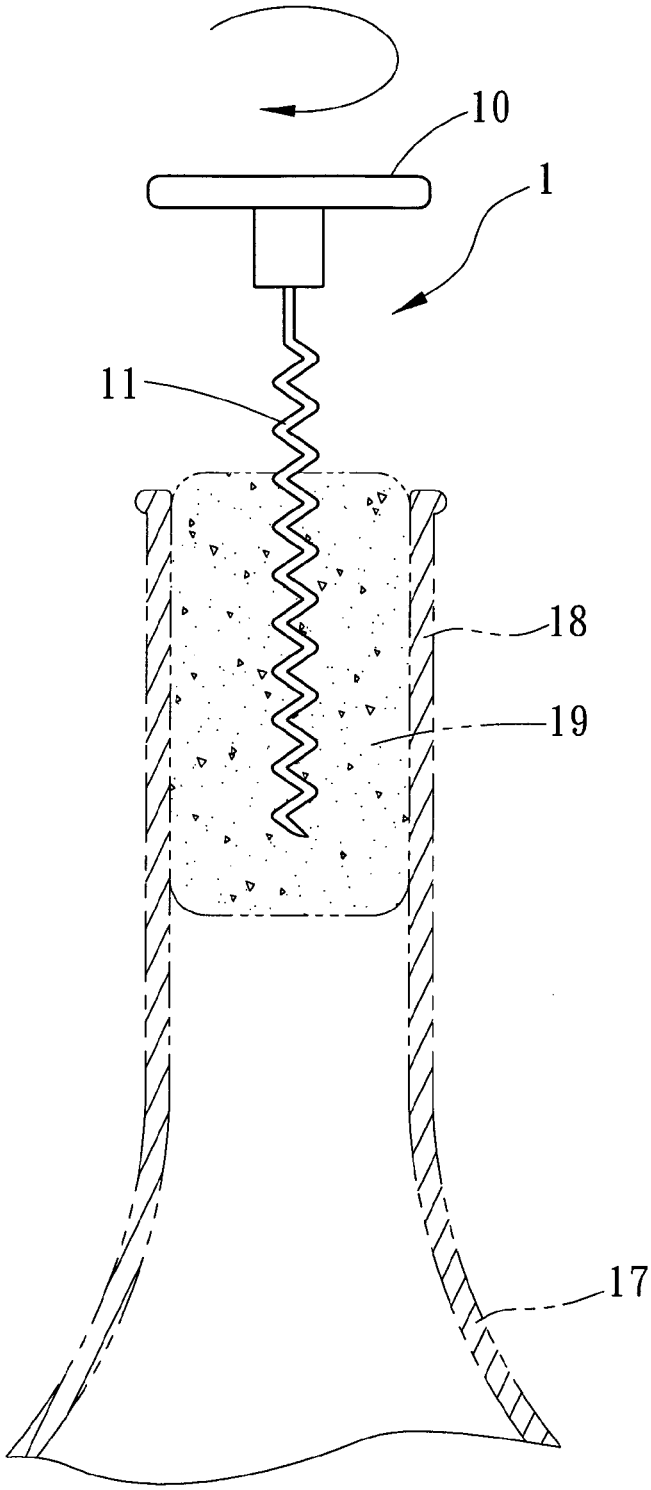
FIG.1 (PRIOR ART)
FIG. 1 is a cross-sectional view of a conventional wine bottle opener.
Figure 2:
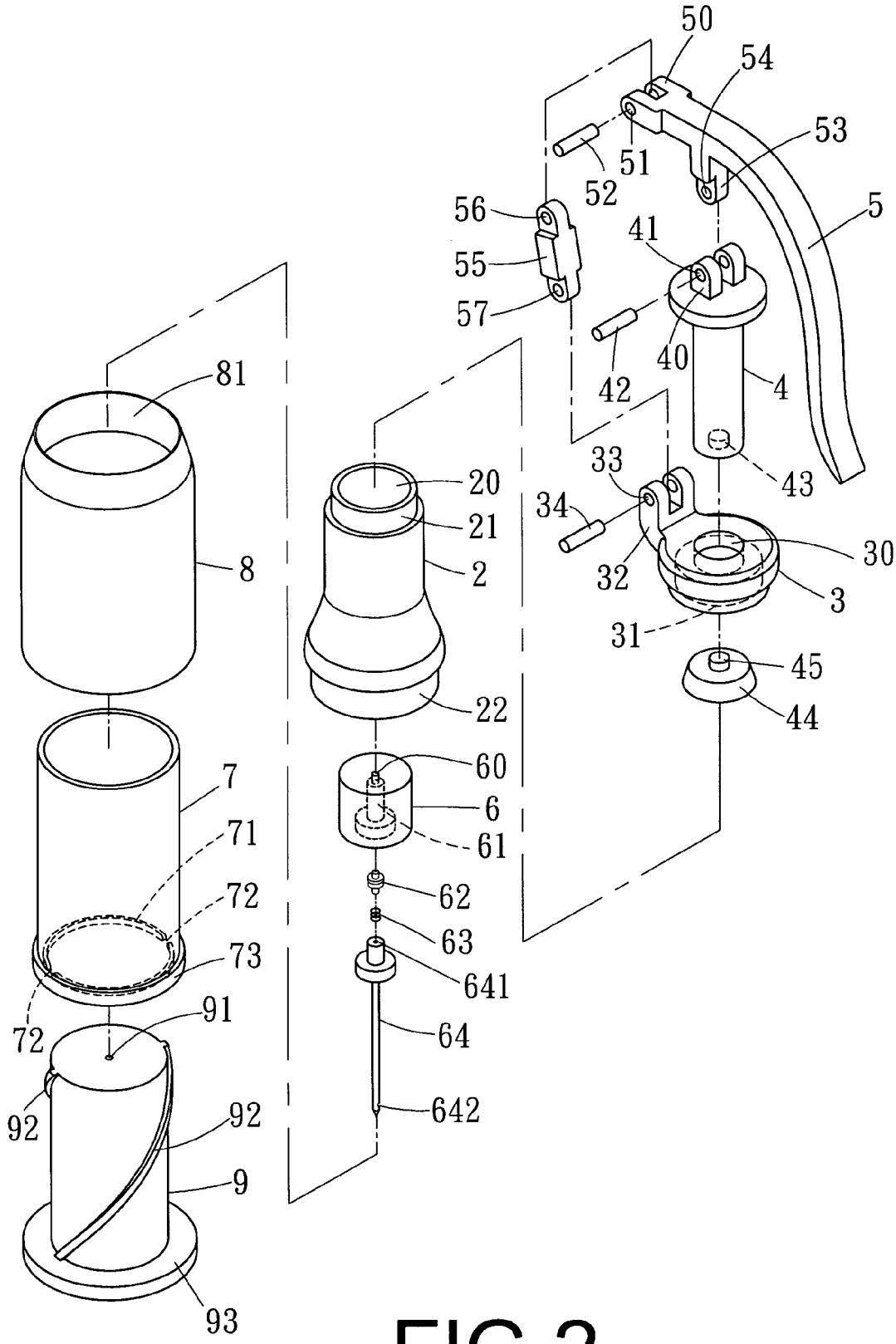
FIG. 2 is an exploded perspective view of a hand-operated wine bottle opener in the present invention.
Figure 3:
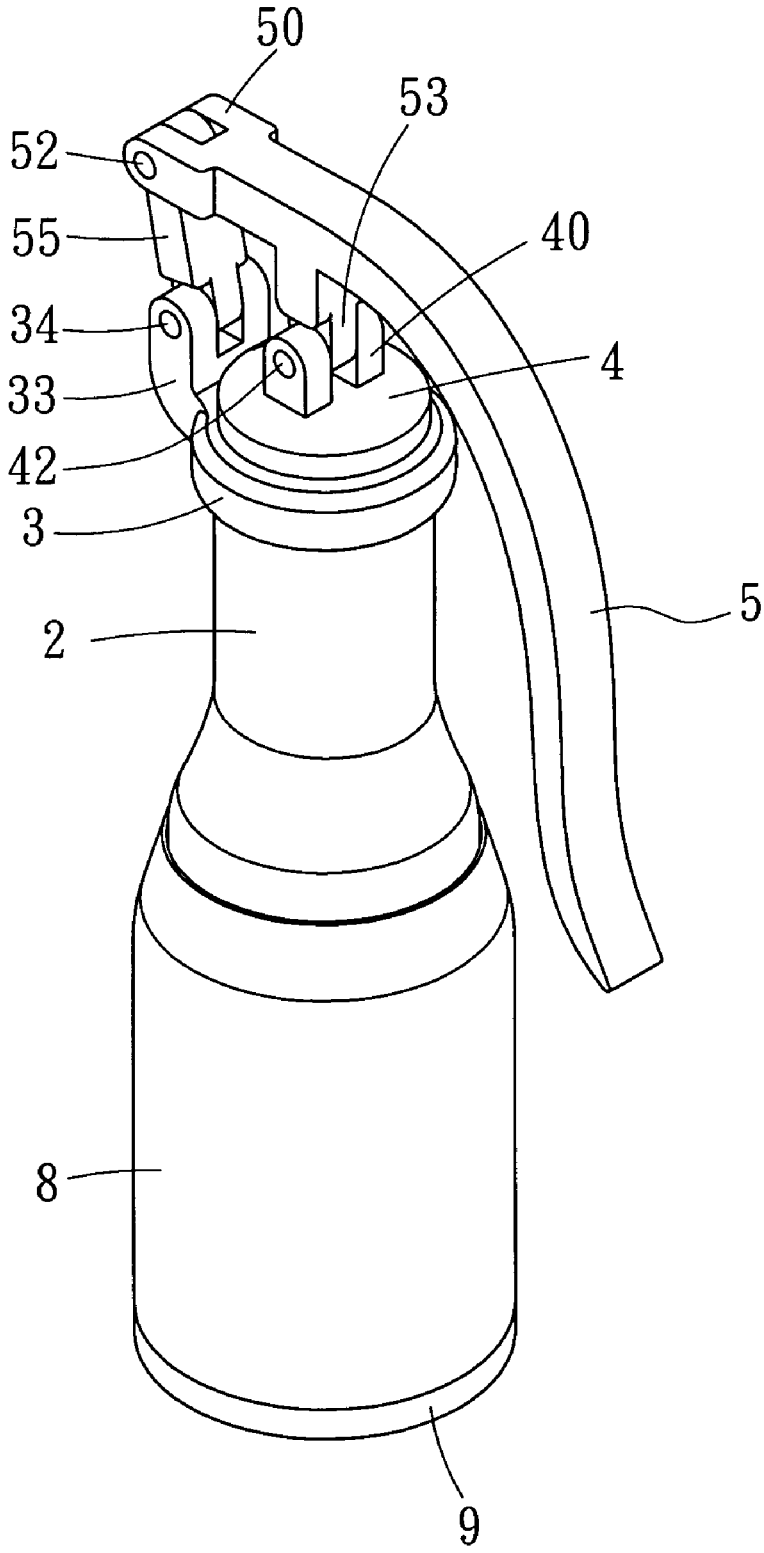
FIG. 3 is a perspective view of the hand-operated wine bottle opener in the present invention.
Figure 5:
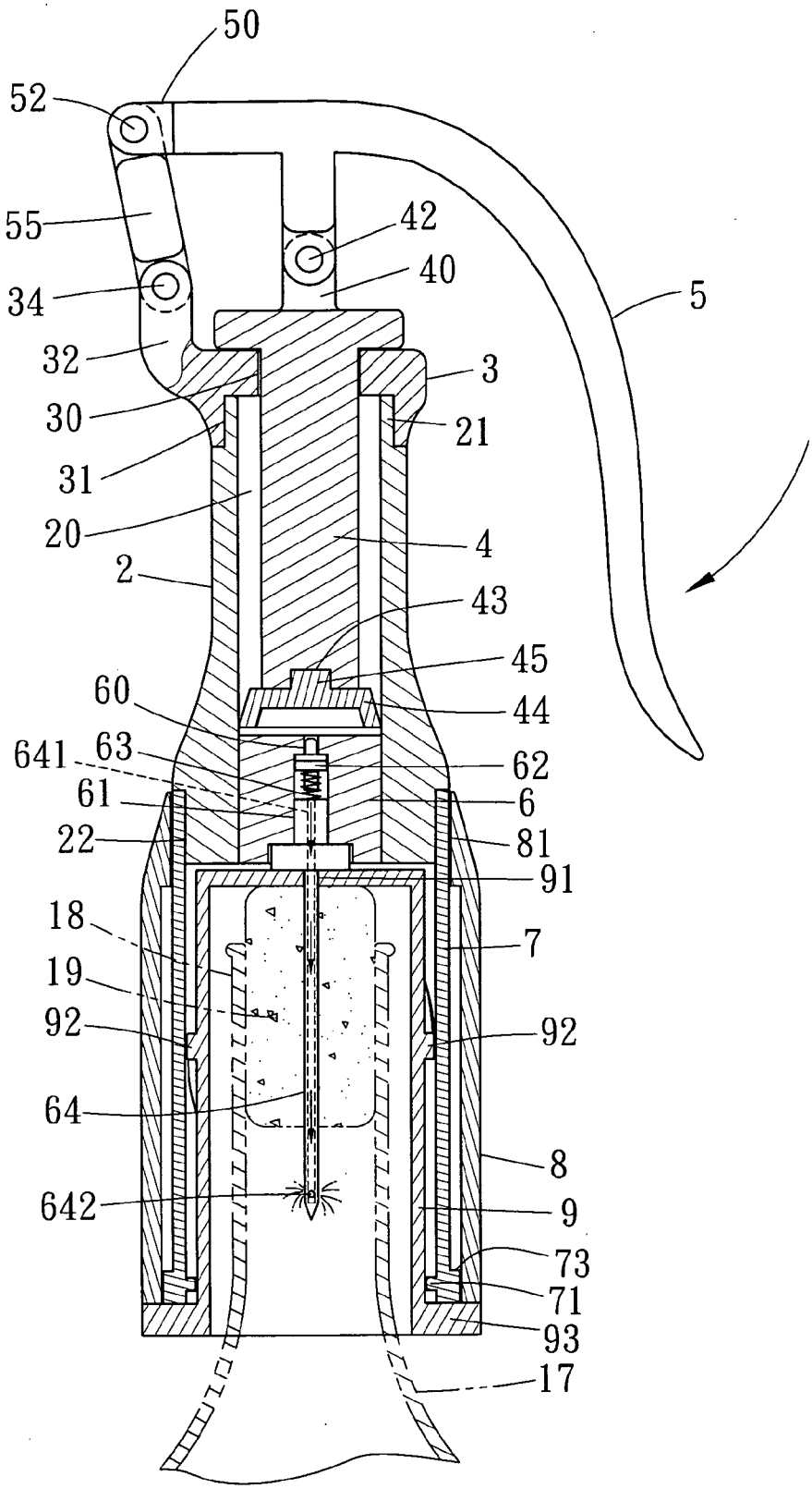
FIG. 5 is a cross-sectional view of the hand-operated wine bottle opener having its press lever pressed downward in the present invention.

A preferred embodiment of a hand-operated wine bottle opener in the present invention, as shown in FIGS. 2, 3 and 5, includes a main body 2, a fixing base 3, a piston rod 4, a press lever 5, a valve base 6, a thimble 7, a sleeve 8 and a slide member 9 combined together.

The main body 2 has its interior formed with a through accommodating chamber 20, an upper connecting member 21 formed in its upper end, and a lower connecting member 22 formed in its lower end.

The fixing base 3 to be fixed on the upper side of the main body 2 is bored with a center insert hole 30 having its lower side formed with a recessed groove 31. The fixing base 3 further has one side disposed with a pivot base 32 having shaft holes 33 for a pivot 34 to be inserted therein.

The piston rod 4 is inserted through the insert hole 30 of the fixing base 3 and positioned in the accommodating chamber 20 of the main body 2. The piston rod 4 has its topside fixed with a pivot base 40 having a shaft holes 41 for a pivot 42 to be inserted therein, and its lower side bored with a recessed hole 43. A piston 44 is fitted at the underside of the piston rod 4, a convex head 45 secured on the topside.

The press lever 5 to be pivotally assembled on the topside of the piston rod 4 has one end formed with a pivot base 50 having shaft holes 51 for a pivot 52 to be inserted therein and has its underside fixed with a pivotal lug 53 with a shaft hole 54. A connecting member 55 has its opposite ends respectively bored with a shaft hole 56, 57, and its opposite ends respectively and pivotally connected with the pivot base 50 of the press lever 5 and the pivot base 32 of the fixing base 3.

The valve base 6 to be received in the accommodating chamber 20 of the main body 2 is bored with an air intake 60, having its interior formed with an accommodating chamber 61 installed therein with a non-return valve 62 having its underside fitted with a spring 63. An insert needle 64 having an air intake 641 in the interior and an air exhausting hole 642 in the lower end is combined with the underside of the valve base 6.

The thimble 7 is shaped hollow to be assembled with the lower side of the main body 2, having its inner wall near the bottom fixed thereon with a projecting ring 71 with two opposite notches 72. The thimble 7 further has its lower outer wall provided with a stop edge 73.

The sleeve 8 is shaped hollow to be fitted around the outer surface of the thimble 7, having its upper inner wall provided with a projecting stop edge 81.

The slide member 9 to be received in the thimble 7 has its lower side fixedly combined with the lower end of the sleeve 8 and its topside bored with an insert hole 91 in the center. Further, the slide member 9 has its outer surface provided with two corresponding helical projections 92 and its lower end disposed with a fixing flange 93.

In assembling, as shown in FIGS. 2, 3 and 5, firstly, the piston rod 4 is inserted through the insert hole 30 of the fixing base 3, and the piston 44 is fixed at the underside of the piston rod 4. Next, the pivotal lug 53 of the press lever 5 is combined with the pivot base 40 of the piston rod 4, letting the press lever 5 pivotally assembled on the piston rod 4 by the pivot 42. Then, the connecting member 55 has its upper end combined with the pivot base 50 of the press lever 5, letting the upper end of the connecting member 55 pivotally combined with the press lever 5 by the pivot 52, having its lower end assembled with the pivot base 32 of the fixing base 3, with the lower end of the connecting member 55 pivotally combined with the fixing base 3 by the pivot 34. Subsequently, the piston rod 4 has its lower end and the piston 44 received in the accommodating chamber 20 of the main body 2, and the main body 2 has its upper connecting member 21 fixed in the recessed groove 31 of the fixing base 3. Then, the non-return valve 62 and the spring 63 are orderly received in the accommodating chamber 61 of the valve base 6, and the insert needle 64 is fitted at the underside of the valve base 6. Afterward, the thimble 7 is positioned in the sleeve 8, and the upper end of the thimble 7 is firmly combined with the lower connecting member 22 of the main body 2. Lastly, the slide member 9 is fitted in the thimble 7, having its two helical projections 92 respectively positioned in the two notches 72 of the projecting ring 71 on the lower inner wall of the thimble 7. Then the fixing flange 93 of the slide member 9 is secured with the lower end of the sleeve 8, and the insert needle 64 is inserted in the insert hole 91 of the slide member 9, thus finishing assembly of the hand-operated wine bottle opener.

Figure 4:
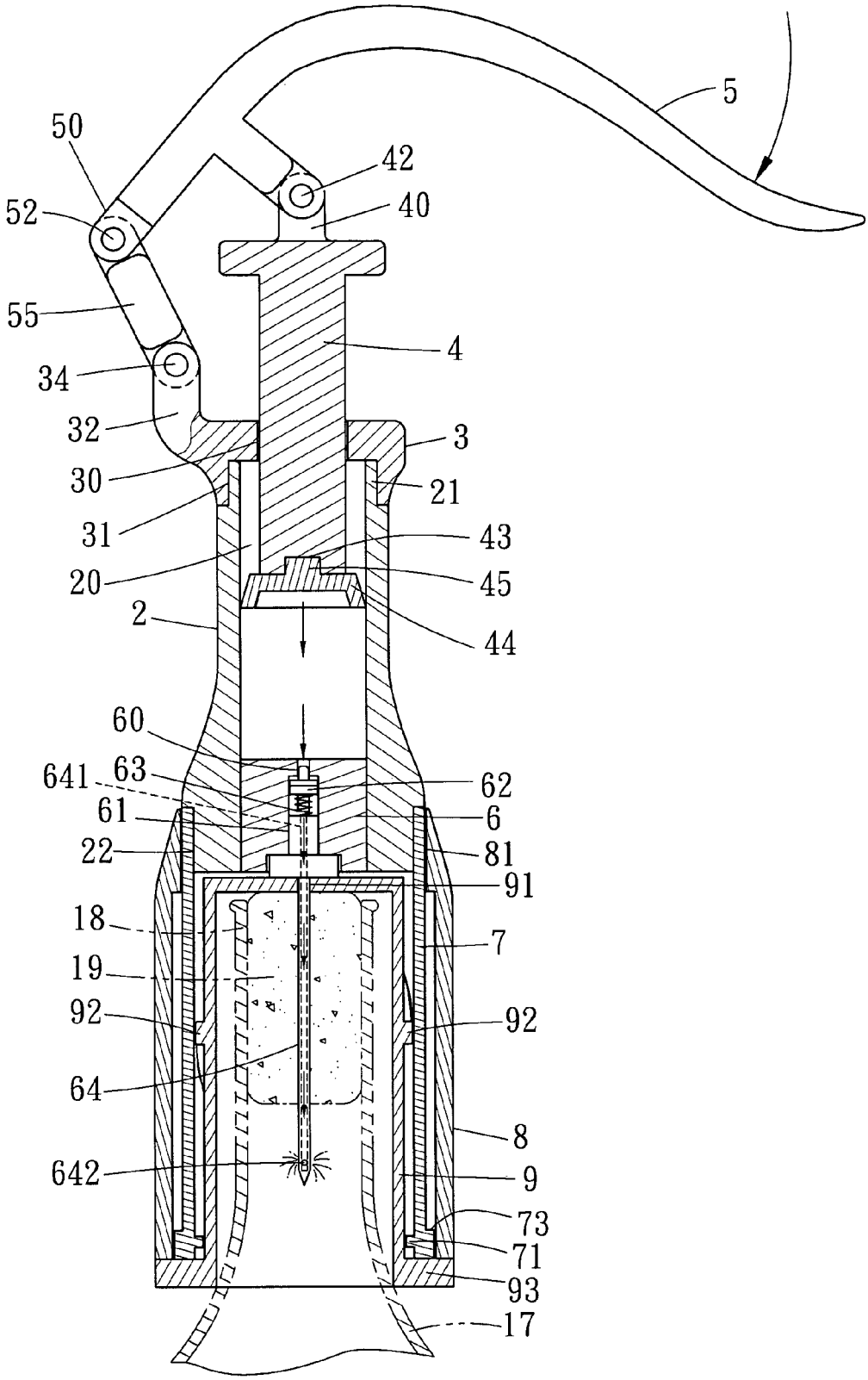
FIG. 4 is a cross-sectional view of the hand-operated wine bottle opener having its press lever pressed downward for pumping air into a wine bottle in the present invention.
Figure 6:
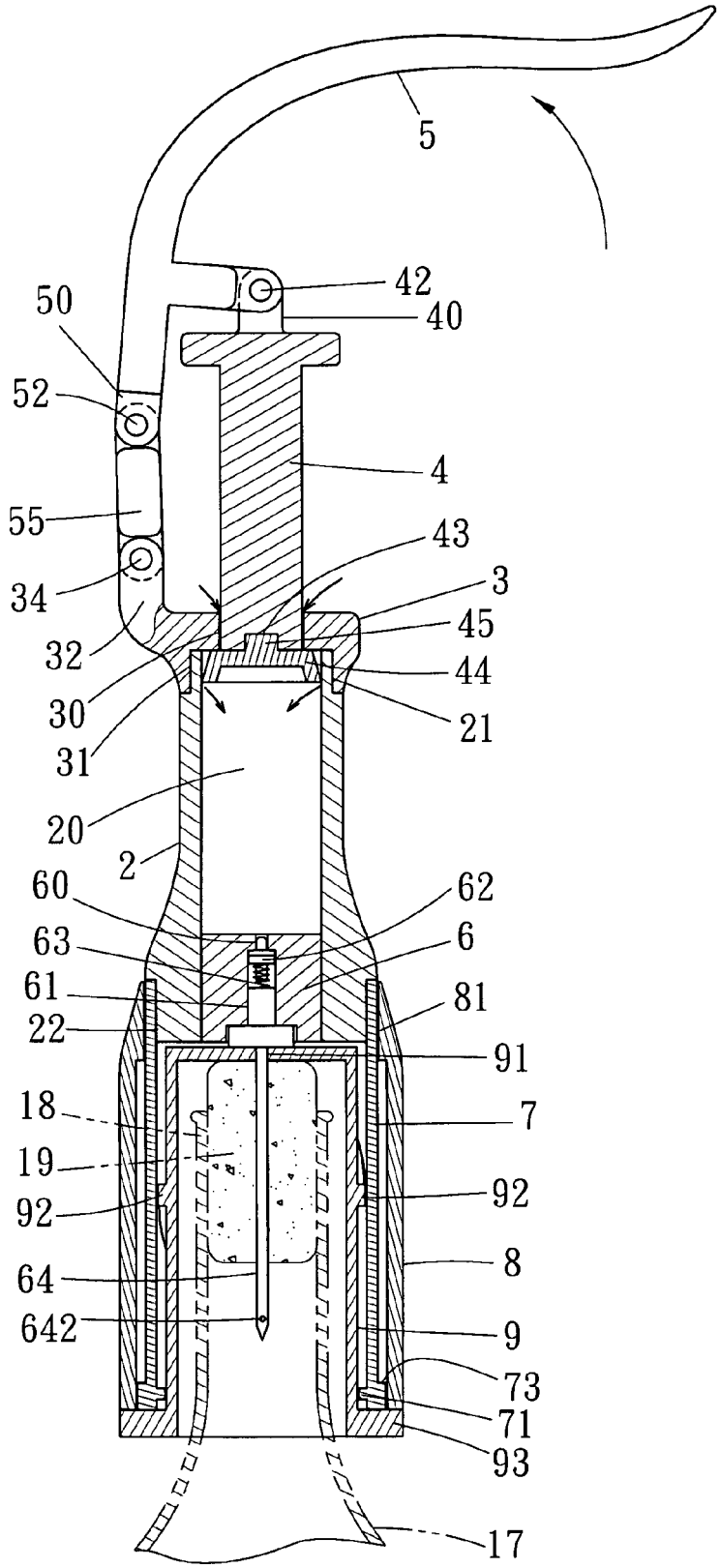
FIG. 6 is a cross-sectional view of the hand-operated wine bottle opener being pulled upward in the present invention.

In using, as shown in FIGS. 4, 5 and 6, firstly, the wine bottle opener of this invention is fitted around the bottle mouth 18 of a wine bottle 17 and the insert needle 64 in the slide member 9 is inserted through a cork 19 of the bottle mouth 18 and has its lower end extending in the interior of the wine bottle 17, and then the press lever 5 is pulled upward and pressed downward reciprocally. When the press lever 5 is pulled upward, the piston rod 4 and the piston 44 is moved upward in the accommodating chamber 20 of the main body 2, letting the accommodating chamber 20 filled up with air. Then, the press lever 5 is pressed downward to move the piston rod 4 together with the piston 44 downward and push the air in the accommodating chamber 20 to flow in the air intake 60 of the valve base 6 to push open the non-return valve 62 and compress the spring 63, enabling the air to flow into the wine bottle 17 through the air intake 641 and the air exhausting hole 642 of the insert needle 64. After the air in the accommodating chamber 20 is completely pumped into the wine bottle 17, the spring 63 will recover its elasticity, pushing the non-return valve 63 to move upward and seal the air intake 60 of the valve base 6 to prevent reverse flow of the air. Thus, external air can be pumped into the wine bottle 17 for removing the cork 19 from the bottle mouth 18 by reciprocally pulling upward and pressing downward the press lever 5 to move the piston 44 up and down repeatedly in the accommodating chamber 20 of the main body 2, able to uncork a wine bottle conveniently and quickly.

Figure 7:
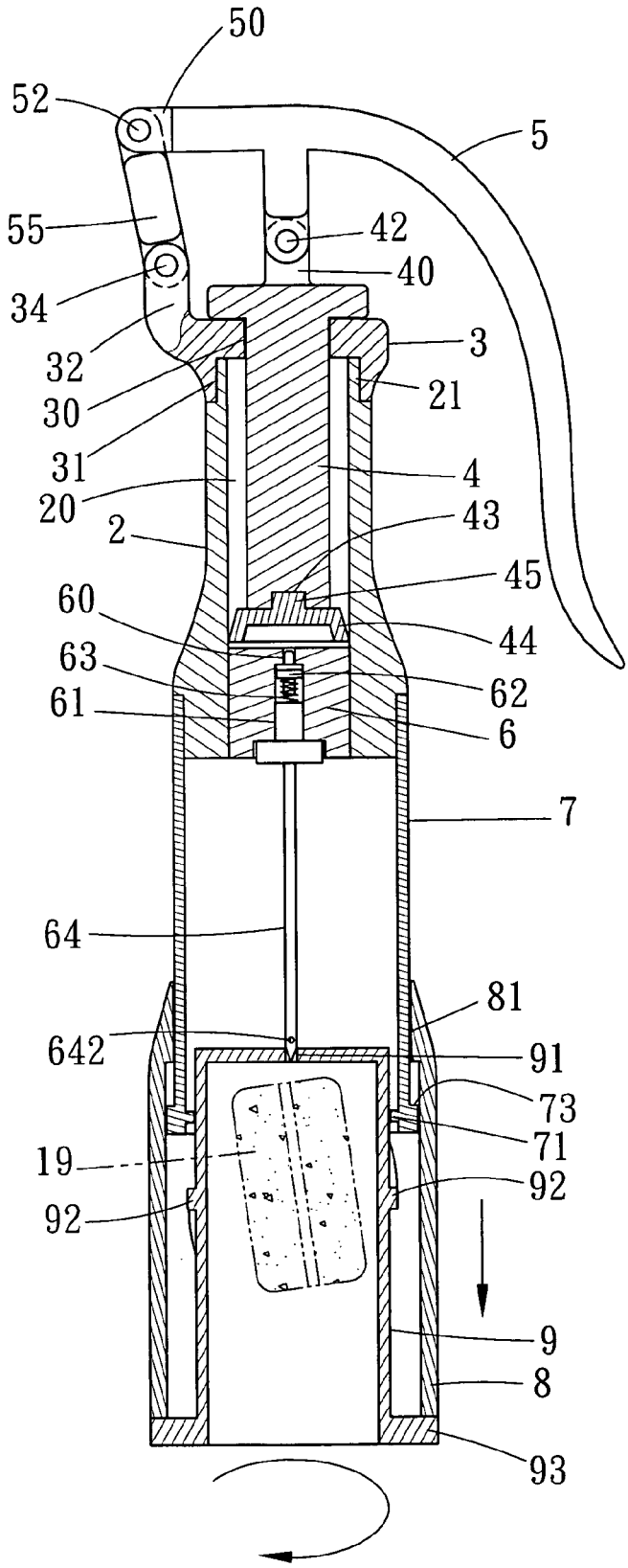
FIG. 7 is a cross-sectional view of the hand-operated wine bottle opener in a condition of removing a cork from an insert needle in the present invention.

After the cork 19 is removed from the bottle mouth 18 of the wine bottle 17, it is still stuck by the insert needle 64 and positioned in the slide member 9. To disengage the cork 19 from the insert needle 64, as shown in FIG. 7, the sleeve 8 together with the slide member 9 is turned around clockwise to actuate the two helical projections 92 to whirl and shift along the two notches 72 of the projecting ring 71 of the thimble 7. Since the thimble 7 is firmly fixed on the lower side of the main body 2; therefore, when the slide member 9 is rotated together with the sleeve 8, they will be slidably shifted downward, but the insert needle 64 is kept stationary. Simultaneously, the cork 19 is moved downward together with the slide member 9 to disengage from the insert needle 64 and drop down from the slide member 9. Then, the sleeve 8 together with the slide member 9 is rotated counterclockwise to let the slide member 9 moved into the thimble 7 and the sleeve 8 covered on the outer side of the thimble 7 and the insert needle 64 positioned in the slide member 9 again to finish collapsing of the wine bottle opener.

While the preferred embodiment of the invention has been described above, it will be recognized and understood that various modifications may be made therein and the appended claims are intended to cover all such modifications that may fall within the spirit and scope of the invention.

I claim:

1. A manual wine bottle opener comprising:

a main body having its interior formed with an accommodating chamber;

a fixing base firmly mounted on said main body and bored with an insert hole in the center;

a piston rod inserted through said insert hole of said fixing base and positioned in said accommodating chamber of said main body said piston rod having its underside fitted with a piston;

a press lever pivotally assembled on the topside of said piston rod;

a valve base secured in said accommodating chamber of said main body, said valve base bored with an air intake and provided with a non-return valve in its interior, said valve base having its lower side fixed with an insert needle, said insert needle bored with an air intake and an air exhausting hole; and a thimble firmly combined with the lower side of said main body; and wherein said thimble has its outer surface fitted around with a sleeve and its interior receiving a slide member, said slide member fixed with said sleeve, said slide member having its topside bored with an insert hole in the center for said insert needle to bc inserted therethrough.

* * * * *